United States Patent [19]

Miller

[11] 4,119,154

[45] Oct. 10, 1978

[54] METHOD AND APPARATUS FOR TREATING BALLAST

[75] Inventor: John R. Miller, Charlotte, N.C.

[73] Assignee: Southern Railway Company, Washington, D.C.

[21] Appl. No.: 770,277

[22] Filed: Feb. 18, 1977

[51] Int. Cl.[2] ..... E01B 27/10

[52] U.S. Cl. ..... 171/16; 104/7 A

[58] Field of Search ..... 171/16; 37/104; 104/7 R, 7 A, 7 B

[56] References Cited

U.S. PATENT DOCUMENTS

| | | | |
|---|---|---|---|
| 1,918,348 | 7/1933 | Neddermeyer | 171/16 |
| 2,552,649 | 5/1951 | Protzeller | 37/104 |
| 2,769,172 | 10/1956 | Franco | 104/7 A |
| 2,886,904 | 5/1959 | Kershaw | 37/104 |
| 2,899,759 | 8/1959 | Campbell | 37/104 |
| 2,921,390 | 1/1960 | Stein et al. | 37/104 |
| 2,924,897 | 2/1960 | Christoff | 37/104 |
| 2,926,616 | 3/1960 | Talboys | 104/7 R |
| 2,961,972 | 11/1960 | Christoff | 37/104 |
| 2,993,451 | 7/1961 | Peppin | 37/104 |
| 3,020,853 | 2/1962 | Christoff | 37/104 |
| 3,091,187 | 5/1963 | Christoff | 37/104 |
| 3,114,330 | 12/1963 | Christoff | 104/7 A |
| 3,316,666 | 5/1967 | Speno | 171/16 |
| 3,326,298 | 6/1967 | Speno | 171/16 |
| 3,436,848 | 4/1969 | Peppin et al. | 37/104 |
| 3,811,382 | 5/1974 | Buchter | 37/104 |
| 3,850,251 | 11/1974 | Plasser et al. | 171/16 |
| 3,957,000 | 5/1976 | Plasser et al. | 171/16 |
| 3,967,396 | 7/1976 | Maisonneuve et al. | 171/16 |
| 4,042,035 | 8/1977 | Boyer | 171/16 |
| 4,043,398 | 8/1977 | Folser et al. | 171/16 |

*Primary Examiner*—Russell R. Kinsey
*Assistant Examiner*—Paul J. Hirsch
*Attorney, Agent, or Firm*—Watson, Cole, Grindle & Watson

[57] ABSTRACT

Ballast is removed from beneath railroad ties in accordance with a ballast treating method and apparatus without disturbing the ballast in the cribs between adjacent ties, and is deposited into a trench formed along the railway. The crib ballast is likewise removed and deposited in the trench. A plow structure used for the ballast removal operation has cutting blades curved toward the trench and disposed with their leading ends lying along a line sloping rearwardly away from the trench. The rail vehicle which supports the plow structure is stabilized against transverse forces imposed on the vehicle during the ballast removal operation, and the plow itself is likewise stabilized against such forces.

27 Claims, 24 Drawing Figures

FIG. 3
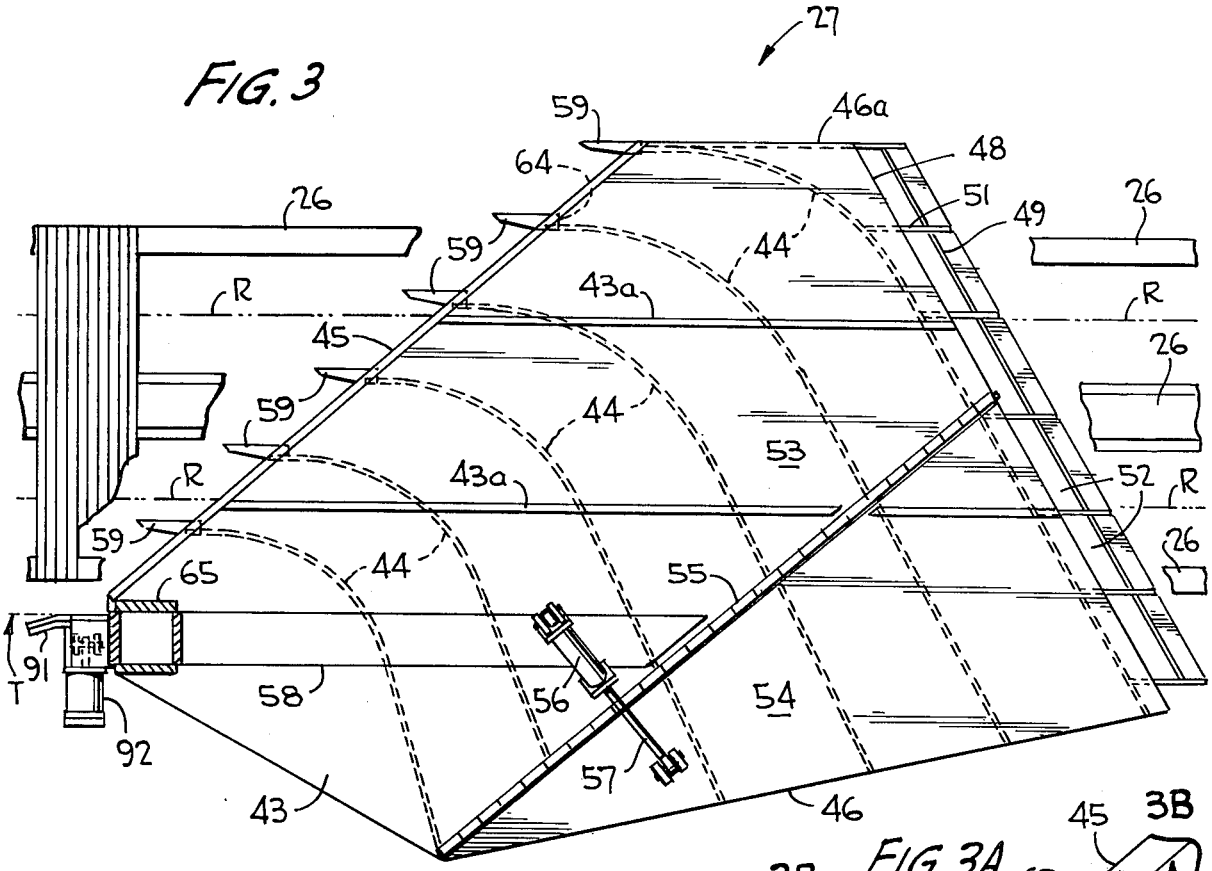
FIG. 3A
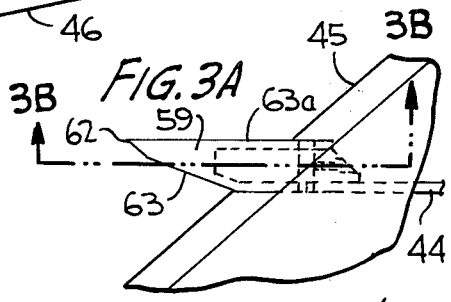
FIG. 3B
FIG. 4
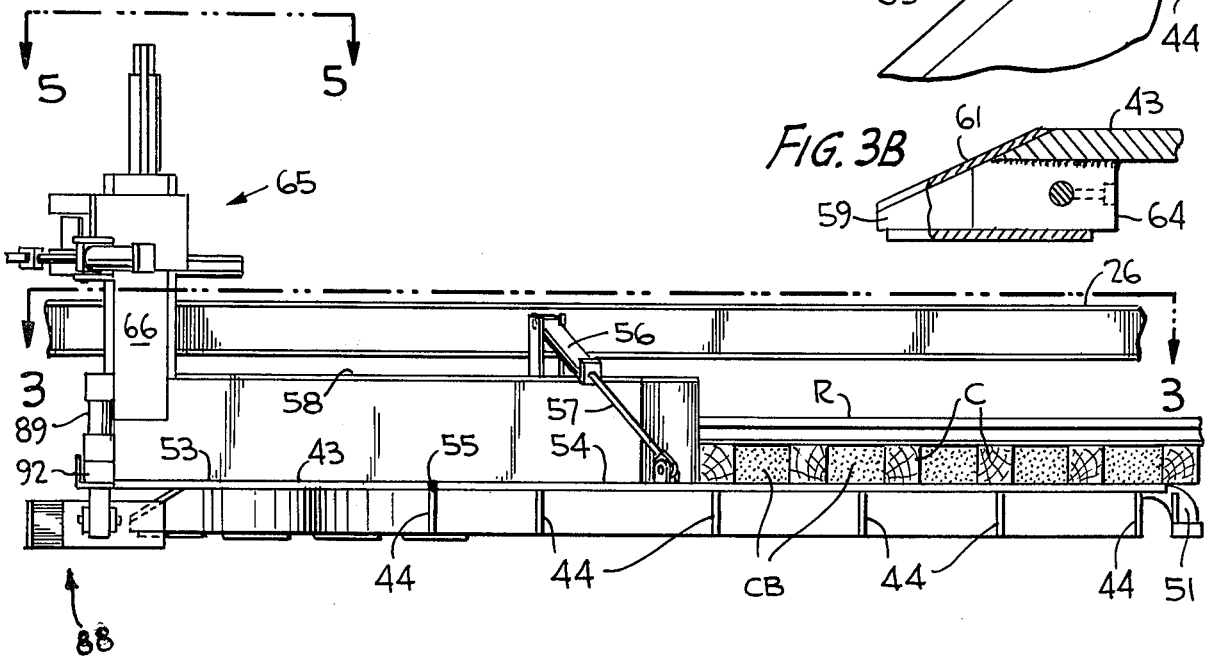

METHOD AND APPARATUS FOR TREATING BALLAST

BACKGROUND OF THE INVENTION

This invention relates generally to an improved method and apparatus for the treating of railroad ballast, and more particularly to a manner of removing the ballast.

Any number of approaches have been developed in the past for the purpose of undercutting, i.e., for the removal of ballast from between railroad ties or from beneath the ties or from both shoulder sections by mechanical means. The types of machinery available generally fall into the category of undercutters, plows, plows and sleds, cribbers and shoulder cleaners. Undercutters are generally based on an endless-chain principle and in most machines the old ballast can be reclaimed, cleaned and returned to the track in a single operation. The plow is a solid metal V-shaped blade having wings and a towing harness to facilitate drawing of the plow under the track structure either by an engine or a stationary pull car. However, with the use of plows there is no acceptable way at the present time to recover any portion of the old ballast for reuse in the track. A sled is usually used in connection with the plow for distribution of a uniform layer of ballast under the ties in advance of surfacing units. Cribbers are much smaller than undercutters and have an endless-chain arm which can remove the old ballast from beneath the ties for a distance half the length of the tie, there being two machines which must work opposite one another to completely remove the crib. (Cribbers reaching along the full length of the tie are also available.) The shoulder and crib material can then be cleaned and returned to the track area by the use of shoulder-cleaning machines, or may be plowed off and wasted or used to restore the subgrade. This technique is slow, tedious and expensive and is seldom used except in isolated short areas. The plow and sled or cribber and shoulder cleaner are not in the true sense undercutters since this equipment is designed to skeltonize the track of the contaminated ballast so as to leave the skeltonized track on a relatively smooth level subgrade. Ballast material is then deposited on the subgrade thereby resulting in full replacement of the ballast section. Use of such devices also is slow, tedious and expensive.

The presence of any number of conditions may generally determine when to use undercutters as, for example: when the ballast becomes so contaminated and fouled that it will not properly drain water, when the surface of the track deteriorates to such an extent as to affect its holding characteristics, and when track joints are found to be pumping mud. Evidence of crushed railroad ties and corrugated rails likewise indicate the need for undercutting. The need to conserve the use of ballast and to change the type of ballast can be satisfied by undercutting, as well as a need to restrict overhead or ground structures. And, the proximity of adjacent side tracks and structures as, for example, switches and turnouts, may determine the particular type of undercutting operation required.

In the past when an undercutter, plow or out-of-face surface machine reached a turnout, the ballast removal operation ceased because of the obstacles encountered at such a track location. This resulted eventually in a sagging condition at the turnout compared to the adjoining track, as well as a poor surface end line. Also, the unremoved fouled ballast at the turnout resulted in poor drainage, poor riding conditions and expensive maintenance. Switch undercutters and switch tampers are now available and these machines can perform the work to rehabilitate turnouts either in a programmed undercutting area or only for reconditioning the switches. One switch undercutter machine is an on-track unit having an endless chain equipped with cutting and raking teeth. The chain works on a horizontal plane and its race is supported by a horizontal arm. The undercutting arm can be raised and lowered, swung transversely to place it at an angle or parallel with the track, and can be moved laterally. These movements enable the machine to undercut turnouts and multiple tracks placed on close track centers. It undercuts several inches below the bottom of the ties and rakes the ballast out to the shoulder of the track.

However, operation of a switch undercutter is expected to require a crew of nine or ten men. The turnout is first undercut from a point just ahead of the head block to beyond the switch ties. Since the fouled ballast removed must be wasted, it is plowed off to the side in open-track territory or a back hoe is used to excavate a trench alongside the track into which the waste material is placed when next to adjacent trackage. While the switch is in a skeltonized condition, the ties are renewed and respaced as necessary and the rail anchors are adjusted. New ballast is then unloaded and the turnout is raised, tamped and lined. As a result, about 6 inches of clean ballast is placed under the ties and the turnout is raised sufficiently to conform to that of the adjoining track.

Of the different undercutting and ballast removal equipment available today, the plow and the chain are probably most widely used. The endless-chain type machine, however, is limited in the amount of ballast material capable of being removed as well as the rate at which the machine is capable of traveling so that the production rate for such machine is relatively low. And, besides the inability of recovering any portion of the fouled ballast for reuse when a plow undercutter is used, such a device is generally incapable of undercutting at turnouts since it is pulled by a bridle arrangement. Also, it is difficult to control direction of the plow if any appreciable amount of undercutting is to be done since keels are provided for counteracting the side forces. And, many plow types use long front runners to raise the ties and rail a considerable distance above the ballast and then plow or scrape the ballast to the side, returning the ties and track to the scraped surface.

SUMMARY OF THE INVENTION

It is an object of the present invention to provide a ballast treating method and apparatus capable of removing several times the amount of ballast material and of travelling several times faster compared to other known machines to thereby produce a significantly increased rate of production.

A further object of this invention is to provide such a method and apparatus capable of working turnouts, crossovers and double and single tracks as conditions permit.

A modular setup, pulled by locomotives, is used for the system according to the invention. The arrangement of work modules is determined by the desired job to be performed. A trench is excavated along one side of the track adjacent the ties, and ballast is removed from beneath the ties and deposited into the trench. Ballast removal is carried out with the use of a plow structure which includes an imperforate plow plate having depending cutter blades thereon with the leading ends lying along a line sloping rearwardly across the track. The cutting blades in part curve toward one side of the railway car at which the plow structure is supported. Wedges extend forwardly of each cutting blade leading end and are so arranged as to facilitate a cutting and a shifting of the ballast without interference from an adjacent wedge. A scraper blade is spaced from the railing edge of the plow plate so as to present an opening therewith into which crib ballast falls for removal by the scraper blade into the trench. The removed ballast is then picked up from the trench and conveyed to a cleaning station and redeposited back beneath the cross-ties of the track. And, car stabilizer and plow stabilizer means depending respectively from the car and the plow bear against an inner wall of the trench so as to resist transverse forces acting on the car and plow during the ballast removal operation. The plow is articulated and is capable of being conveniently stored on the railway vehicle, and the car stabilizer is likewise capable of being similarly stored.

BRIEF DESCRIPTION OF THE DRAWINGS

FIG. 3 is a top plan view of the plow structure shown in FIG. 1 but at a slightly enlarged scale;

FIG. 3A is a top plan view, at an enlarged scale, showing the details of a typical plow wedge;

FIG. 3B is a sectional view taken substantially along line 3B-3B of FIG. 3A;

FIG. 4 is a side elevational view of the plow structure of FIG. 3;

DETAILED DESCRIPTION OF THE INVENTION

Figure 1A:
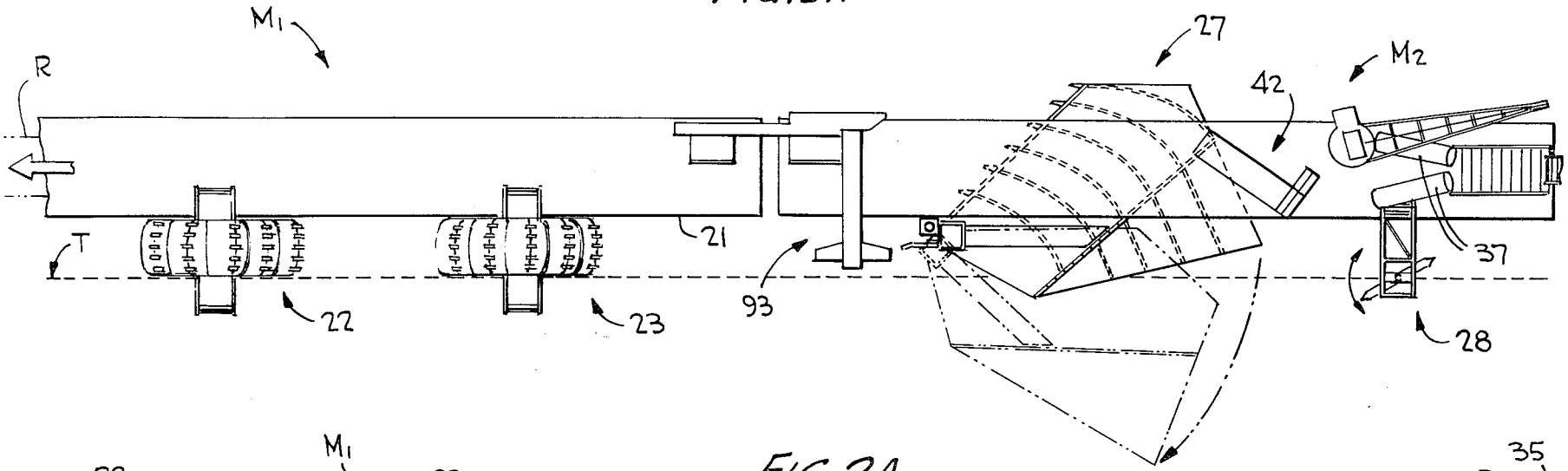
FIGS. 1A and 1B are general plan views of the overall system in accordance with the invention.

Turning now to the drawings wherein like reference characters refer to like and corresponding parts throughout the several views, the overall system provided for the treatment of railroad ballast is generally illustrated in FIGS. 1A, 1B, 2A and 2B. The system essentially comprises a modular setup of coupled railway vehicles $M_1$, $M_2$, $M_3$ and $M_4$ respectively forming work modules pulled by locomotives (not shown) for traveling in the direction of the arrow shown in FIG. 1A on a track including rails R fixed to cross ties *c* resting on a ballast bed B (see FIG. 10) with cribs between adjacent ties filled with crib ballast CB (see FIG. 4). The particular arrangement of work modules will be determined by the particular operation to be performed, as will more clearly be brought out hereinafter. For a single pass, undercut, and clean ballast consist the locomotives would be followed by the following work modules.

Figure 16:
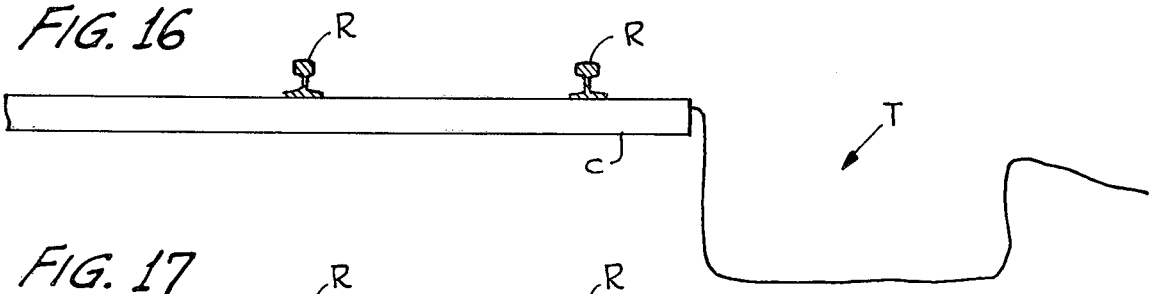
Figure 17:
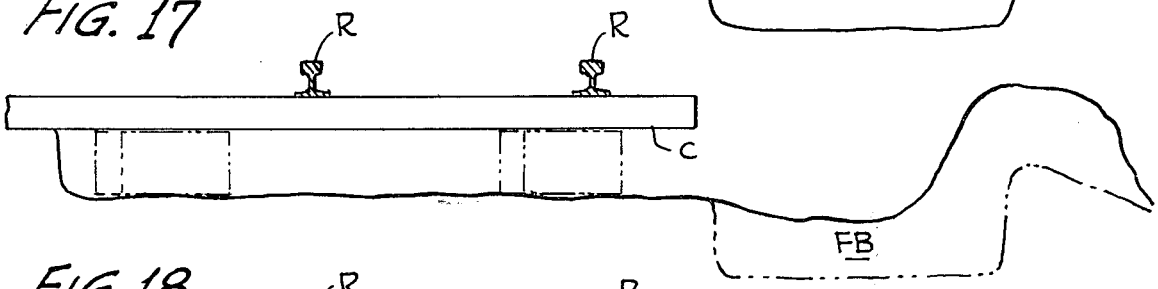
Figure 18:
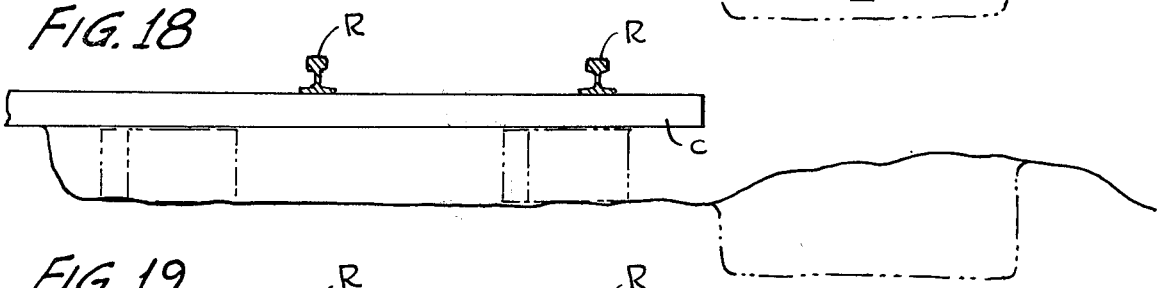

First, car $M_1$ having a flatbed support 21 and wheels W running along rails R, is equipped with subsoiler plows (not shown) and digging trencher wheels generally designated 22 and 23. These trencher wheels extend outwardly of one side of the car and are powered in any normal manner for excavating a trench T of a width and depth illustrated by dotted lines in FIGS. 1 and 2. Both trencher wheels are mounted on their respective arms 24 for adjusting the elevation thereof in any normal manner, trencher wheel 22 normally however being disposed at a higher elevation relative to wheel 23 so that the trench may be excavated to its determined depth during two passes of the wheels. Trench T is formed parallel to the track along one side and adjacent the ends of the cross ties as typically shown in FIG. 16. The excavated material is conveniently conveyed along outside the trench.

The car forming module $M_2$ follows next and has its flatbed 25 supported on framing 26 (FIG. 3) with its wheels W engaging the rails. An undercutter plow arrangement generally designated 27 is mounted on this car $M_2$ is disposed for removing fouled ballast from beneath the ties and depositing same in trench T. A side or regulating plow generally designated 28 is also mounted on this car and extends over a side of and slightly into the trench so that an operator may shift the fouled ballast in different directions, which ballast has been deposited in the trench and is suitable for cleaning or for reuse. The undercutter plow arrangement 27 and the side plow 28 will be described in more detail hereinafter.

Figure 19:
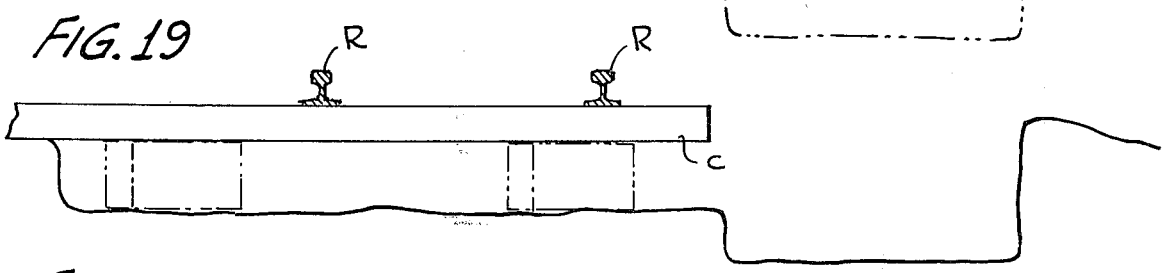
Figure 20:
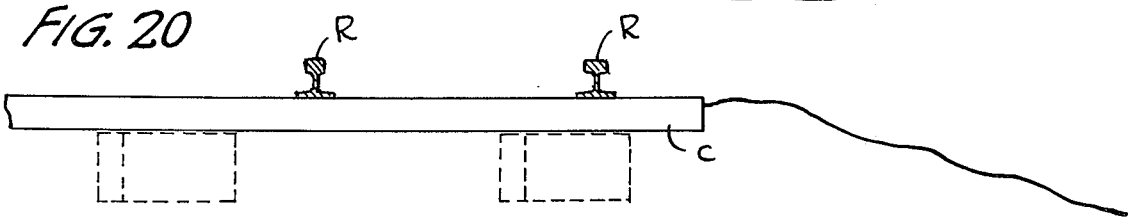

Another car forming module $M_3$ follows next and has a pair of trencher wheels generally designated 29 and 31 mounted on flatbed 32 of this car for operation in any normal manner. As similarly provided for the digging trencher wheels, these wheels are mounted on their respective arms 33 for adjusting the wheel elevation, and the wheels are designed to take up a predetermined amount of fouled ballast for depositing it onto conveyors 34. For convenience the forward trencher wheel 29 can be disposed at a slightly higher elevation relative to the rearward trencher wheel. The fouled ballast is then conveyed by conveyors 34 rearwardly to a cleaning car designated module $M_4$. Car $M_3$ may also have a side regulating plow (not shown) in the vicinity of the trencher wheels 29 and 31 so that the ballast removed from the excavated area can be pulled in if desirable. After some ballast is taken up from the trench, which will now contain some amount of fouled ballast, it may be subsequently filled with excavated material from outside the ditch so as to produce a condition illustrated in FIG. 20 from that illustrated in FIG. 19. A sheep-foot roller (not shown) may be pulled along this area to increase compaction of this pervious material.

The ballast cleaning material car $M_4$ follows the rear trencher wheel car $M_3$ and is equipped with a ballast cleaning system generally including a rotating drum, water submerged, drag chain conveyor system. The ballast is thereby cleaned and then conveyed by conveyors 35 to a storage hopper 36 on plow car $M_2$. From this hopper the cleaned ballast is distributed by discharge chutes 37 into the void behind plow 27 and between the rails through the cribs between adjacent cross ties, while the rails are supported by conventional rail holding rolls 38. The cleaned up ballast could not, however, be placed to the outside shoulder at this distributing location due to the fouled ballast that had been plowed out. Another hopper (not shown) on the ballast cleaning car may be provided to distribute cleaned ballast along such cross tie ends after the trench has been substantially refilled as aforedescribed. Car $M_4$ also includes a variable direction spoils discharge conveyor generally designated 39 for discharging dirt and debris left from the cleaning operation.

Following the cleaning module could be an air side dump car (not shown) or a water hauling tank car 41 depending on the location for releasing the spoils. And a ballast car or cars (not shown) may follow car 41 for carrying new ballast when needed to be added during operation of the system.

The track realigning, tamping and smoothing operations may be carried out with standard equipment. For working only a turnout and renewing the ballast a trencher car such as $M_1$ and a plow car such as $M_2$ would only be needed to make up the consist. The trencher car would first complete the excavated area. Next, the plow car would remove the fouled ballast from beneath and between the ties at the turnout and deposit it in the trench. Evenly spaced concrete blocks would then be placed beneath the ties while the rails were held at a predetermined elevation by rail holding rolls 38. These concrete support blocks are inserted by means of a block inserter mechanism designated 42 in FIGS. 1A and 2A. Thereafter, the trencher car would make another pass removing the fouled ballast from the trench, and ballast cars moving along the rails would deposit new ballast beneath the ties through the cribs. And, with the track again raised by rolls 38 new ballast may be tamped by conventional means.

Reference is now made to FIGS. 3 and 4 showing the details of the undercutter plow arrangement 27. The plow includes a rigid and imperforate metal plate 43 disposed horizontally beneath cross ties *c* and extending outwardly of opposite sides of the track. Thin longitudinally extending wear plates 43*a* extend longitudinally along the top surface of the wear plate, and a plurality of depending cutting blades 44 are mounted on the undersurface of the plate and extend from a leading edge 45 of the plate toward a side edge 46 thereof. The plate's leading edge slopes rearwardly toward a side edge 46*a* of the plate, which lies substantially parallel to the plate's longitudinal axis. Leading ends 47 (FIG. 3A) of the blades are equally spaced along the plate's leading edges, and the blades each have portions curving toward side edge 46 of the plate with the remainder thereof being substantially straight.

A trailing edge 48 of the plate slopes rearwardly away from side edge 46*a*. A scraper plate 49 is mounted along this trailing edge in spaced relationship thereto and likewise slopes rearwardly away from side edge 46*a*. The scraper plate is mounted to plate 43 by means of support arms 51 which space the scraper plate a predetermined distance to define openings 52 between the trailing edge of plate 43 and plate 49.

Figure 8:
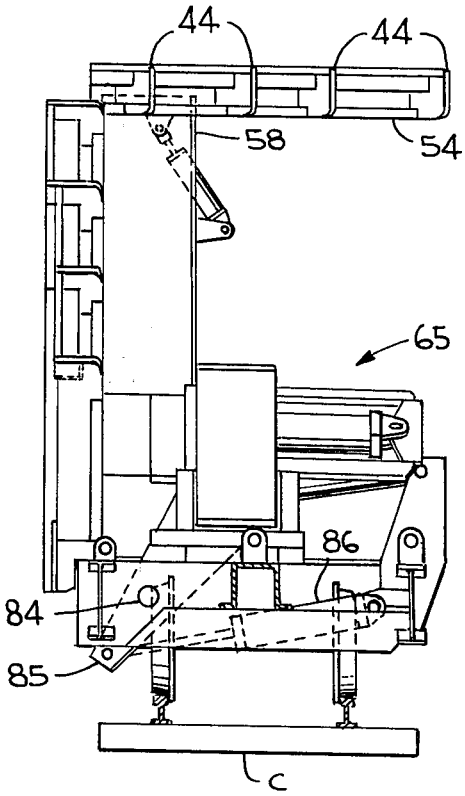
FIG. 8 is an end elevational view of the plow structure shown supported in its stored condition on a railway car.

The plow plate is divided into portions 53 and 54 interconnected along a continuous hinge 55 lying substantially parallel to leading edge 45 of the plate. A hydraulic cylinder 56 and its piston rod 57 are respectively pivotally connected to portions 53 and 54 and are operable to move portion 54 about the hinge toward portion 53 when the undercutting plow is moved into its stored, non-working and transport position shown in FIG. 8. Actually, cylinder 56 is not mounted directly to portion 53 but to the top of a horizontal beam 58 mounted on the top surface of the plow plate and disposed near the ends of the cross ties. This beam serves to strengthen the plate, helps maintain the ballast material in the cribs in place during the plow operation, and may furnish another point of connection to the main carrying frame.

A plurality of wedges 59 extend outwardly of leading edge 45 of the plow plate from the leading ends of the cutting blades. Each wedge has a downwardly sloping top surface 61 terminating in a point 62 from which a work side surface 63 slopes rearwardly toward side edge 46 of the plow plate. Side 63*a* of each wedge opposite the work side is longitudinally disposed for defining a positive holding area. And, the wedges are so arranged along the leading edge of the plow plate that points 62 are disposed laterally of a trailing end 64 of an adjacent wedge.

Figure 7:
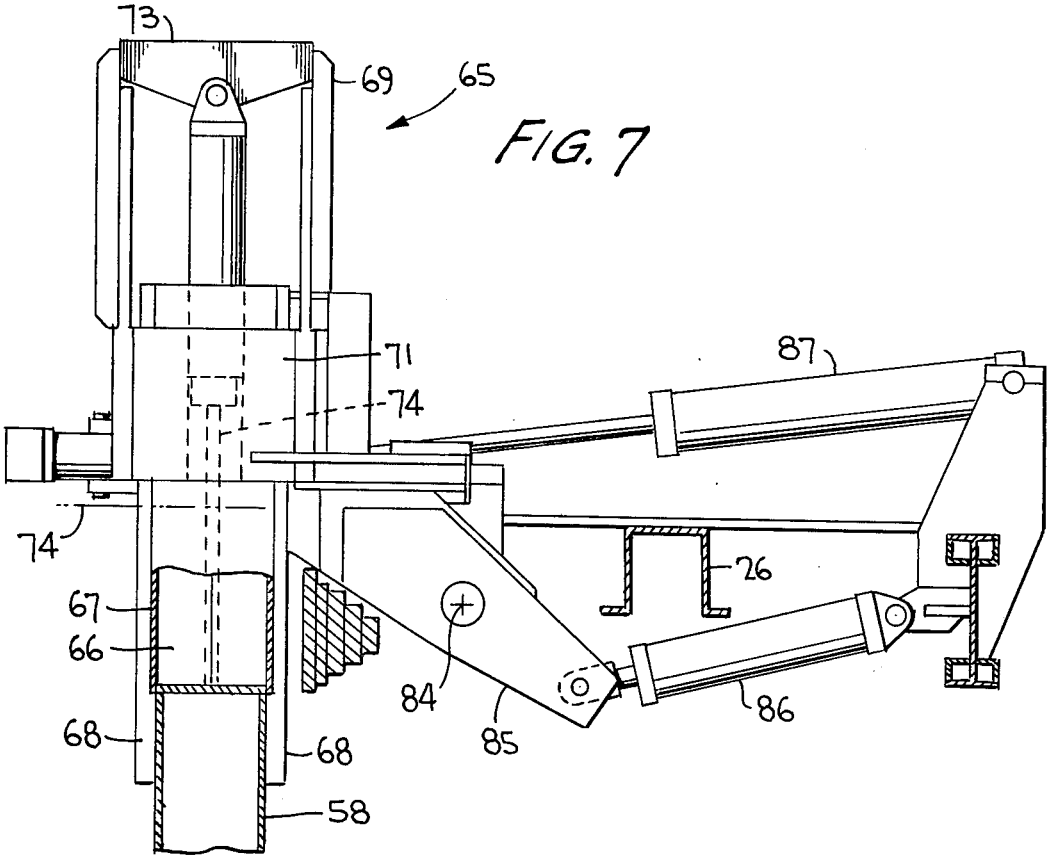
FIG. 7 is an end elevational view taken substantially along line 7—7 of FIG. 5 showing the lifting and moving mechanisms for the plow structure.

A vertical column generally designated 65 includes a post 66 mounted to and upstanding from horizontal beam 58 (see FIG. 7). This post actually comprises a pair of vertical I-beams having side plates 67 secured thereto (FIG. 5) so as to form a box column connected at its lower end to the top of horizontal beam 58. The side plates slide within surrounding plates 68 for telescoping movement. Vertical members 69 are secured to and extend upwardly from a support 71 surrounding plates 68, and a hydraulic cylinder 72 is secured to a cross piece 73 spanning members 69 as clearly shown in FIG. 7. A piston 74 of the cylinder is secured at one end to the top of horizontal beam 58 and extends into cylinder 72 so that, when hydraulic pressure is ported to the lower side of the piston head, post 66 is elevated within plates 68 thereby elevating beam 58 and the undercutter plow accordingly. The top of beam 58 is raised approximately to an elevation of the top of the car framing indicated in FIG. 7 by a line 74.

Figure 6:
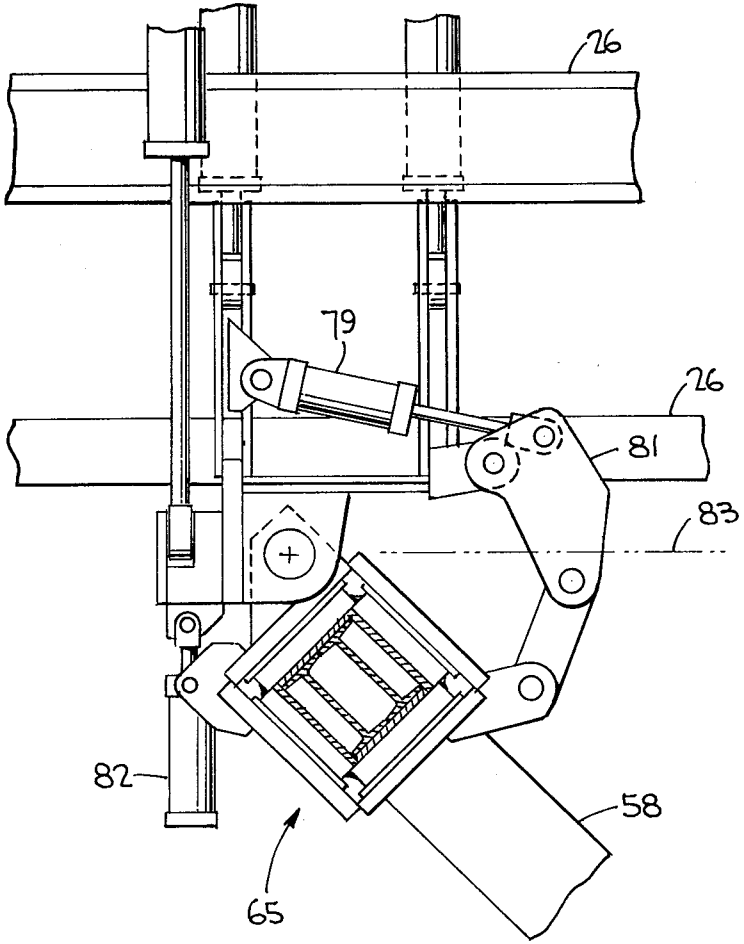
FIG. 6 is a view similar to FIG. 5 showing the plow shifting mechanism with the plow structure so moved to its non-working position.
Figure 5:
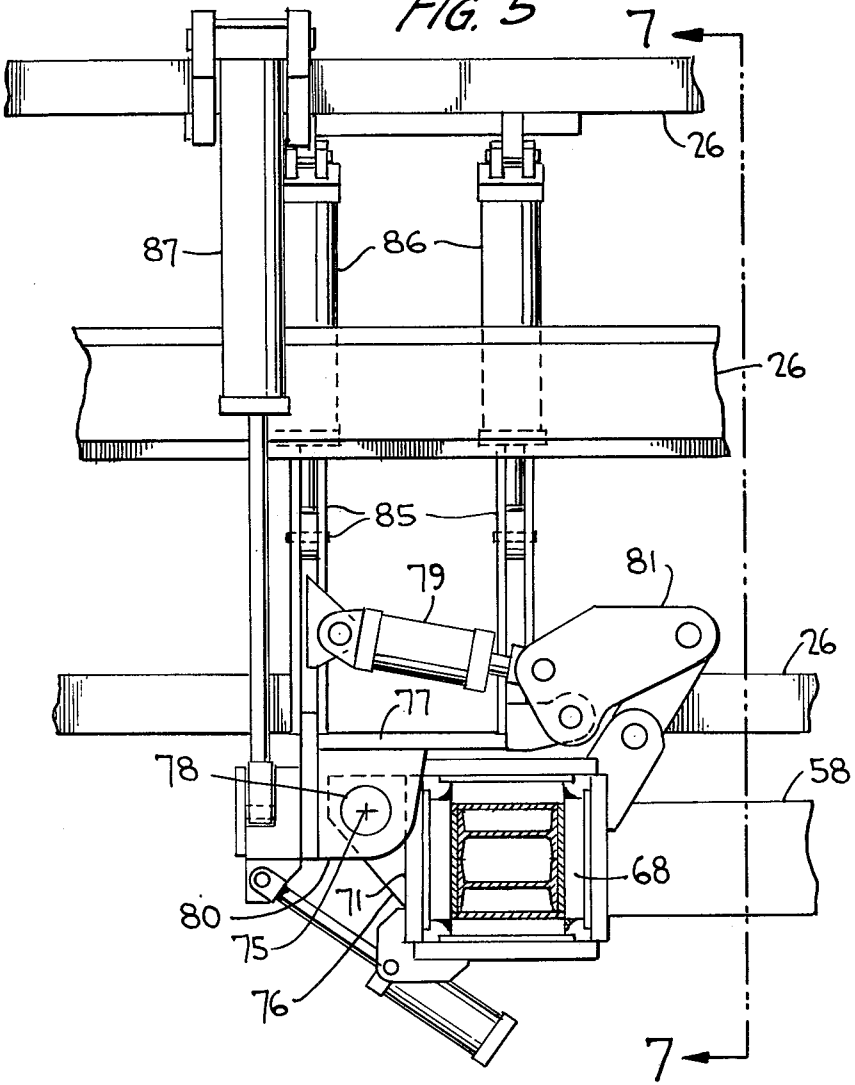
FIG. 5 is top plan view taken substantially along line 5—5 of FIG. 4 showing the shifting and the moving mechanisms for the plow structure.

Plow arrangement 27 is mounted to framing 26 for movement about a vertical axis 75 lying adjacent a side of the rail car. As shown in FIGS. 5 and 6, hinge plates 76 and 80, respectively on a member 71 surrounding the vertical column and on a column support member generally designated 77, are hingedly connected to a hinge pin 78. A hydraulic piston and cylinder unit 79 is connected to a support arm 85 (to be hereinafter described) as well as to a link plate 81 pivotally connected to suitable column support. Plate 81 is linked to column 65 through further linkage as shown. Another hydraulic piston and cylinder unit 82 pivotally interconnects the column with another suitable column support. Therefore, upon actuation of cylinders 79 and 82, the plow arrangement may be shifted from beneath the cross ties wherein beam 58 lies parallel to the railway as shown in FIGS. 3 and 5, to a position of FIG. 6 outwardly of the cross ties wherein leading edge 45 of the plow plate lies parallel to the railway along a line 83 shown in FIG. 6.

After the plow arrangement is shifted to this position, it is elevated by the means aforedescribed until the top of beam 58 reaches an elevation 74 approximately to the level of the car framing. The entire plow arrangement and vertical column are then rotated about a longitudinal axis 84 into a stored, non-working or transport position of FIG. 8. The vertical column is mounted to an end of support arms 85 (FIGS. 5 to 7) for pivotal movement about axis 84. Lower piston and cylinder units 86 connect the free ends of arms 85 with a portion of the car framing, and an upper piston and cylinder unit 87 interconnects the car framing with vertical column 65. Upon actuation of units 86 and 87 the entire plow arrangement and vertical column assembly are pivoted about axis 84 into the stored position of FIG. 8.

With the particular plow arrangement according to the invention, it can be seen that a couple movement will be created as the plow is moved beneath the cross ties as lateral forces are directed toward that side of the car on which the plow is pivotally mounted and toward which the fouled ballast is directed. Accordingly, a plow stabilizer generally designated 88 is provided to counterbalance this couple movement. Stabilizer 88 includes an arm 89 pivotally mounted at its upper end to vertical column 65 and has a horizontally disposed bearing plate mounted at the free end thereof for bearing against an inner vertical wall of trench T (similar to that shown in FIG. 10 for the car stabilizer to be later described). This bearing plate is adjustable toward and away from the inner trench wall by means of a piston and cylinder unit 92 having its cylinder mounted to beam 58 and its piston mounted to arm 89 of the stabilizer. Therefore, the lateral forces directed toward the trench and which are imposed upon the plow are effectively resisted by the plow stabilizer.

Figure 2A:
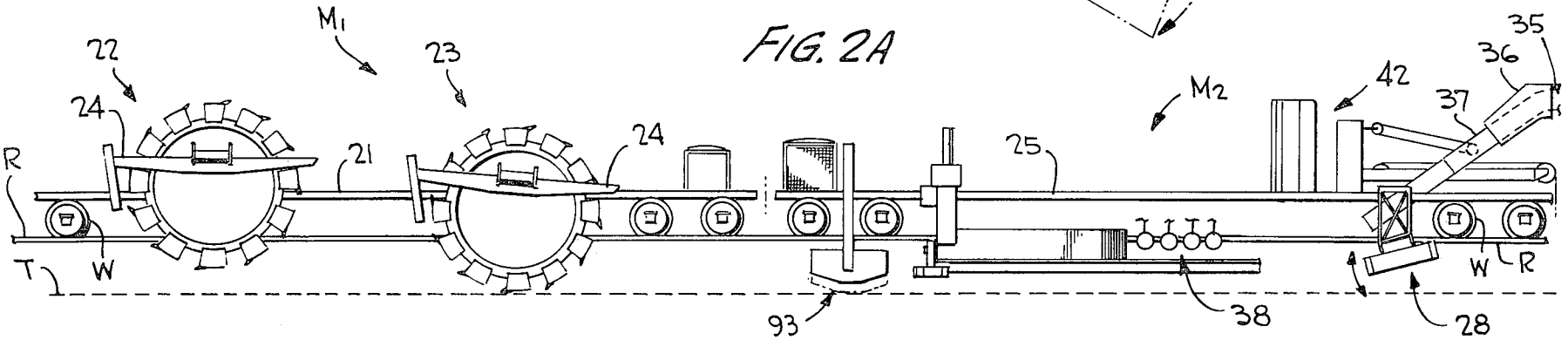
FIGS. 2A and 2B are side elevational views of that shown in FIGS. 1A and 1B.
Figure 1B:
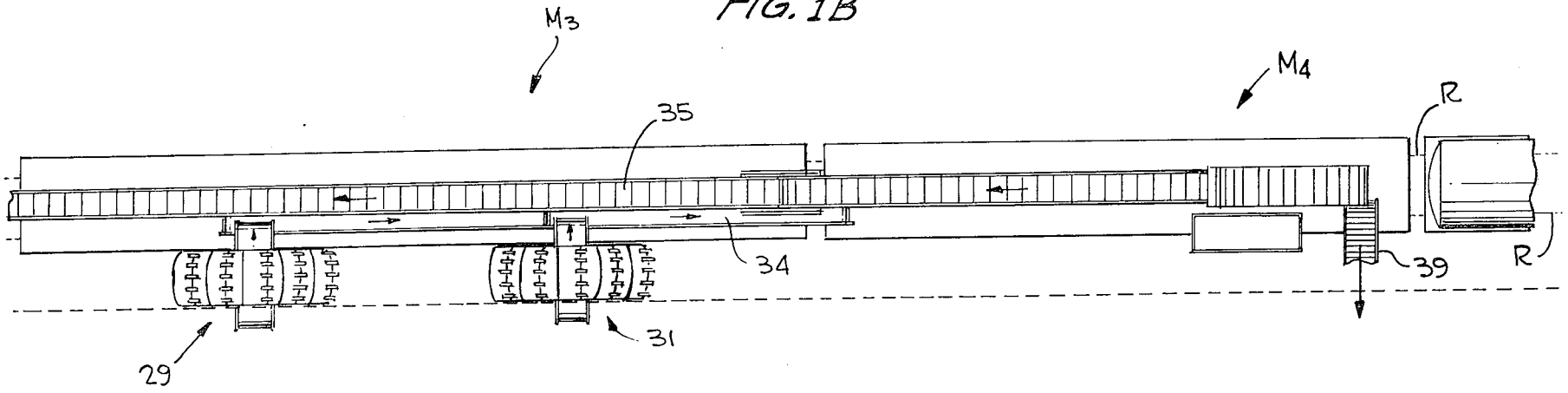
Figure 2B:
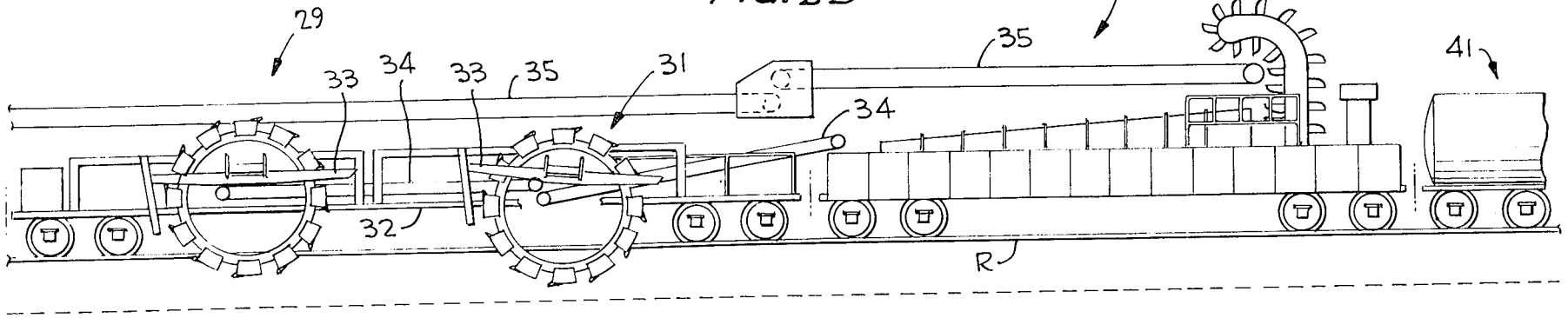
Figure 11:
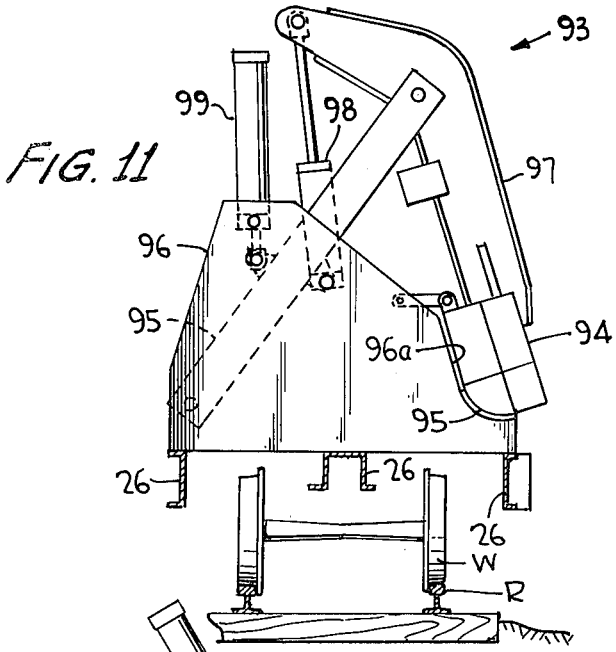
FIG. 11 is a view similar to FIG. 10 except that the vehicle stabilizer is shown in its stored condition on the vehicle.
Figure 9:
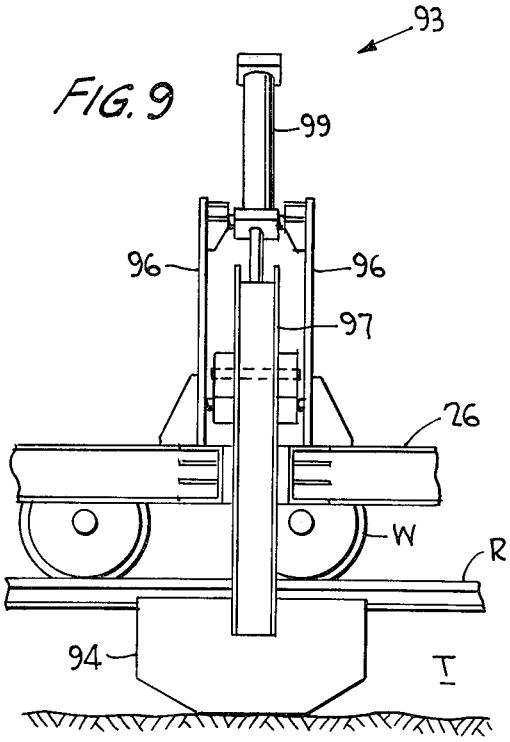
FIG. 9 is a side elevational view of the vehicle stabilizer in its working position.
Figure 10:
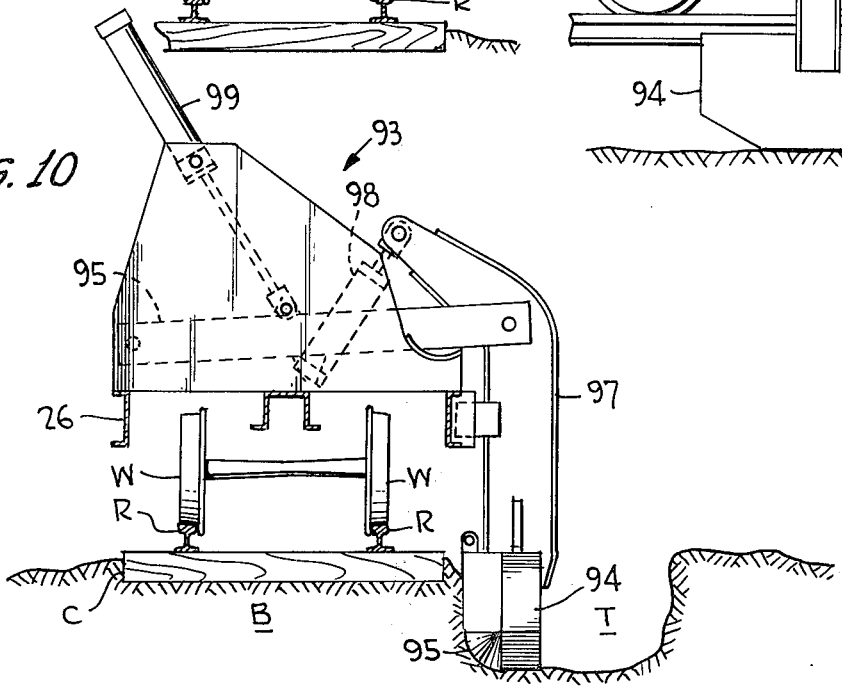
FIG. 10 is an end elevational view of the stabilizer of FIG. 9.
Figure 12:
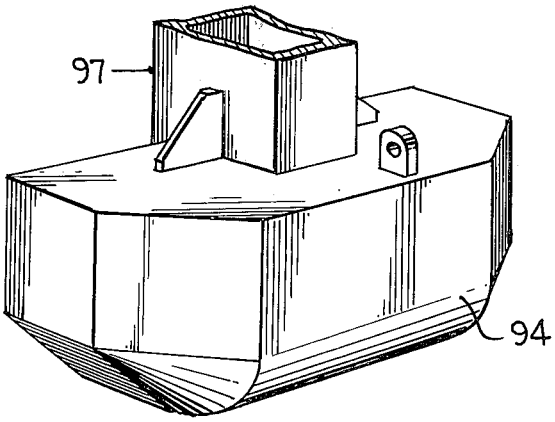
FIG. 12 is a perspective view of the pontoon forming a part of the stabilizer of FIGS. 9 to 11.

A car stabilizer generally designated 93 is also mounted on module unit $M_2$ forwardly of the undercutting plow arrangement (FIG. 2A). As shown in FIGS. 9 to 11, this car stabilizer includes a pontoon 94 having a curved inner bottom 95 and a smooth inner wall for engagement with an inner wall of trench T shown in FIG. 10. A lever arm 95 is hingedly connected at one end to a pontoon support 96 on the car, and at its other end is hinged to a pontoon support member 97. A hydraulic piston and cylinder unit 98 pivotally interconnects support member 97 with a support 96, and another hydraulic piston and cylinder unit 99 pivotally interconnects lever arm 95 with support 96. Therefore, upon actuation of units 98 and 99, the pontoon may be moved into its position from that of FIGS. 9 and 10 to that shown in FIG. 11. Supports 96 are designed as having a cradled profile **96*a* for the reception of the pontoon when in its stored position of FIG. 11. When the pontoon is in its working position of FIGS. 9 and 10**, it acts to stabilize the car by counterbalancing the couplee movement imposed on the plow during plow movement as forces are directed toward the trench.

Figure 13:
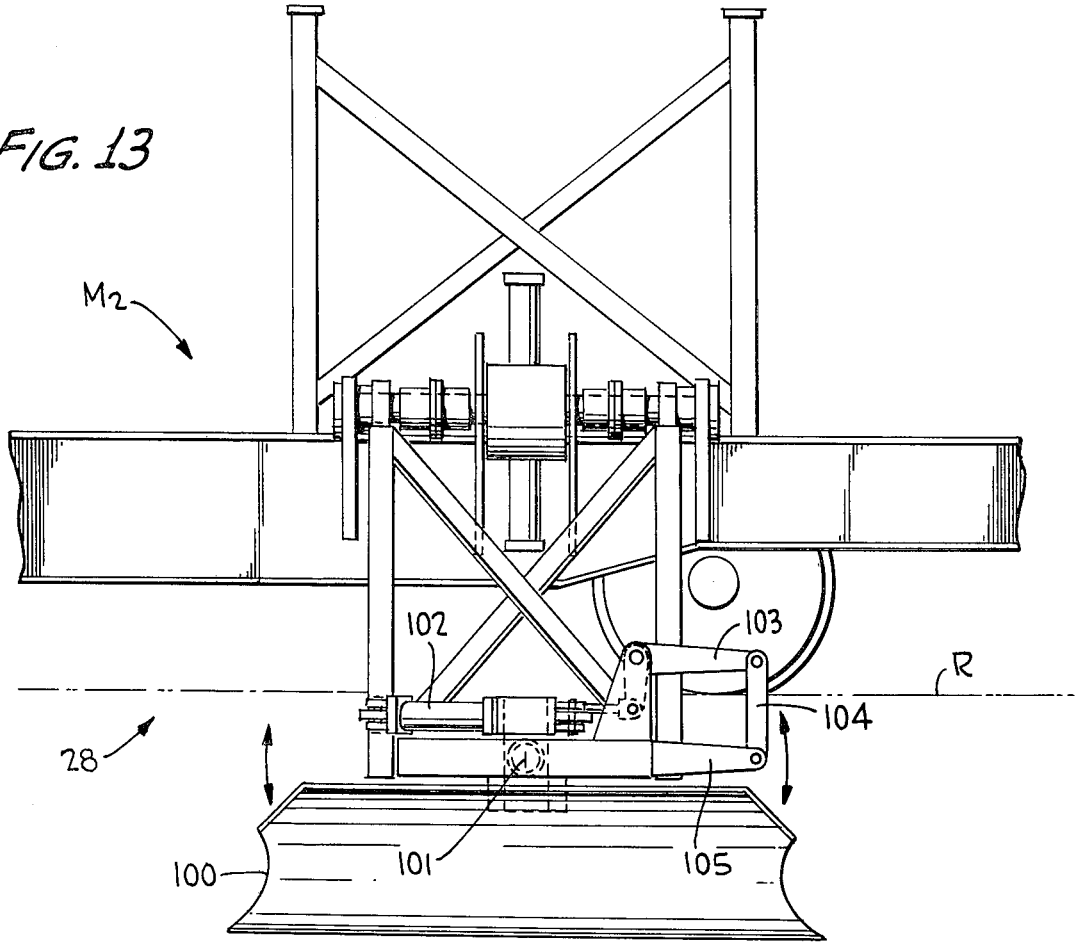
FIG. 13 is a side elevational view of the side plow structure according to the invention.
Figure 14:
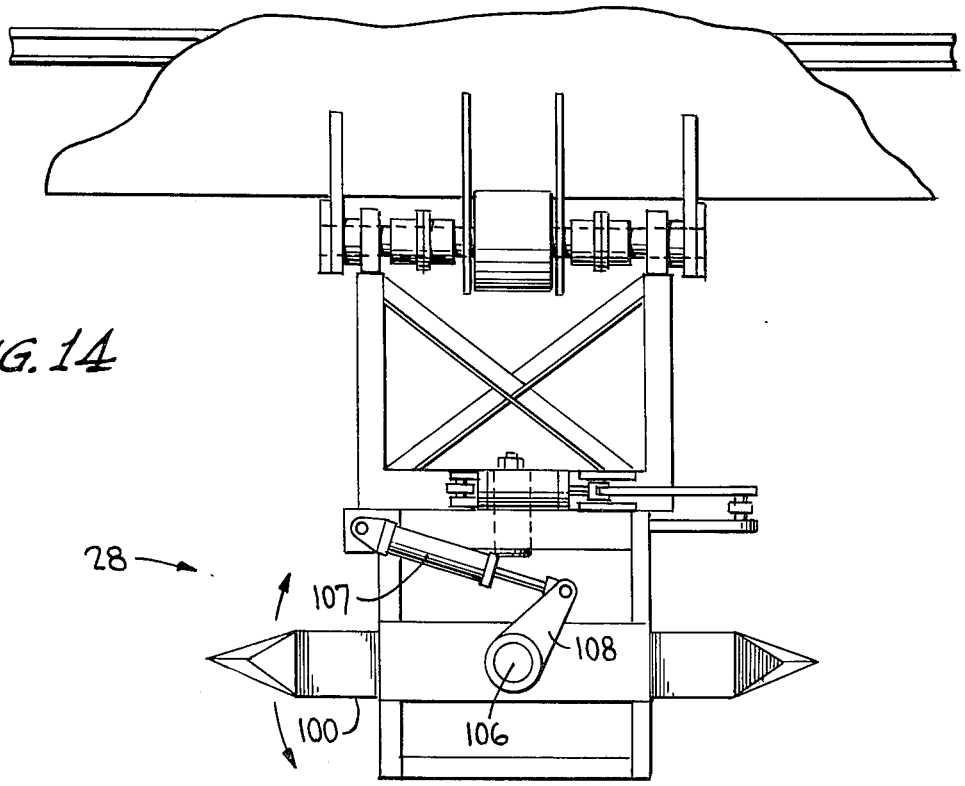
FIG. 14 is a top plan view of the structure of FIG. 13.
Figure 15:
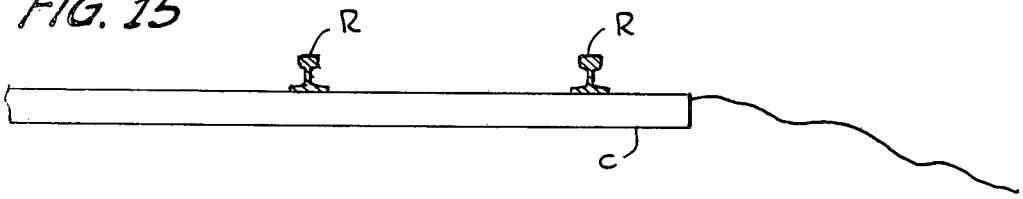
FIGS. 15 to 20 are end elevational view of the track showing the manner in which ballast is removed and redeposited in accordance with the present invention.

Side plow assembly 28 is illustrated in more detail in FIGS. 13 and 14. A plow plate 100 of this assembly is disposed parallel to the railway and extends outwardly of the side of the car and above the trench. It is mounted for slight rotation about a transverse axis 101 by means of a hydraulic piston and cylinder unit 102 connected through a crank 103 and a link 104 to a support 105 of the plow. The plow is likewise mounted for movement about a vertical axis 106 by means of a hydraulic piston and cylinder unit 107 mounted to crank 108. Hence, the fouled ballast deposited in the trench by the undercutting plow may be moved about by the side plow in readiness for being picked up by the rear trencher wheels.

FIGS. 15 to 20 show sections of the railway between a condition before ballast treatment (FIG. 15) to one after such treatment (FIG. 20) for particularly rail turnouts (hence, the reason for the long cross ties) at which the ballast may be conveniently treated in accordance with the invention. The digging trencher wheels excavate a trench T (FIG. 16) adjacent an end of the cross ties, and the plow device 27 deposits fouled ballast FB (FIG. 17) into the trench. The side plow distributes the fouled ballast at the trench (FIG. 18) in readiness for the pick-up trencher wheels which deliver the fouled ballast (FIG. 19 to the ballast cleaning cargo. The fouled ballast remaining in the trench may then be covered with the excavated material lying outside the trench, and compacted by conventional means.

From the foregoing, it can be seen that a unique ballast treating system has been devised including a device for undercutting ballast from beneath cross ties of the railway. The fouled ballast is removed by an undercutting plow arrangement having an imperforate plate which supports both the cross ties and the ballast in the cribs between adjacent ties during the plow operation. Such crib ballast is therefore maintained between the ties for effecting tie control. A scraper plate spaced from the trailing edge of the plow plate defines openings which subsequently permit the crib ballast to fall downwardly from between the ties ahead of the scraper plate for removal into the trench. The ballast cutting and scraping bladdes used in depositing the fouled ballast into the trench have semi-trapezium type wedges extending forwardly of the leading ends thereof. These wedges pierce sections of ballast and during forward travel these sections are thereby transversed if compacted for such a shearing action. If the material is not suitable for shearing, the curved cutting blades apply a moving action to the material during the following several feet of forward plow travel. After the material is loosened, it is conveyed by the cutting blades and deposited into the trench near the cross tie ends. The crib material drops down after the ties have crossed the angled scraper blade supports and is removed to the side trench by the angled scraper blade.

A portion of the fouled ballast material is conveyed to the water ballast cleaning and screening machine, and the cleaned ballast is replaced beneath the ties while they are still suspended above the old ballast bed.

All force producing parts of the present plow arrangement are designed for the purpose of gaining as much couple balancing force as possible. The wedges each have a top leading negative attack angle plus a positive holding area at a side opposite their work side. The plow plate not only has a vertical support column but also a horizontal column extending adjacent the cross tie ends when cutting. Connected to the vertical column is a hydraulically powered sliding stabilizer plate that makes contact with the vertical excavated wall next to the ties for counterbalancing the couple movement of the plow plate. This vertical column is hydraulically powered for vertical movement as well as to tilt from vertical for changing planes between an undercutting position and a stored position.

Forward of the vertical column is a hydraulically operated force opposing pontoon that travels against the inner wall of the excavated area. The force applied here will vary according to the moment of the couple imposed by the undercutting.

Obviously, many modifications and variations of the present invention are made possible in the light of the above teachings. It is therefore to be understood that within the scope of the appended claims the invention may be practiced otherwise than as specifically described.

What is claimed is:

1. A plow structure for removing ballast from beneath the rail ties of a railway, comprising, a flat, rigid and imperforae plate disposed for movement beneath the rail ties in a forward direction of travel along the railway, said plate having a leading edge sloping rearwardly in one direction relative to the longitudinal axis thereof, a plurality of spaced depending blades fixedly mounted on the underside of said plate along said leading eedge and extending toward a side edge of said plate, a portion of each said blade being curved toward said side at said leading edge for cutting and shifting the ballast toward said side upon plate movement, the remainder of said blades each being substantially straight and sloping rearwardly toward said side edge for conveying the cut ballast outwardly of said side, and a depending scraper blade spaced from said plate and mounted thereto along the trailing edge thereof for defining an opening, said scraper blade sloping rearwardly toward said side edge, whereby said imperforate plate prevents any separation of said ties and ballast located therebetween during plate movement, and whereby said opening permits the ballast between the ties to fall forwardly of said scraper blade to be thereby conveyed outwardly of said side of said plate.

2. The plow structure according to claim 1, wherein said plate is divided into two portions hingedly interconnected along a line sloping rearwardly from said side edge, and means connected to said portions for relatively moving them about said line into an angular position when not in use.

3. The plow structure according to claim 1, further including wedges mounted on said plate and extending outwardly of said leading edge, said wedges forming extensions of said blades and each having upper surfaces sloping downwardly away from said undderside of said plate to a leading point of said wedge, and sloping rearwardly at one side thereof away from said point toward said one side for cutting and shifting the ballast toward said one side, each said point being disposed laterally of the trailing end of an adjacent wedge, whereby the ballast may be cut and shifted toward said one side substantially without interference from an adjacent wedge.

4. The plow structure according to claim 1, in combination with a rail car disposed for rolling movement along rails mounted on the ties, said plate being pivotally mounted to said car for movement about a vertical axis, said leading edge sloping rearwardly from said vertical axis, and means provided for moving said plate about said vertical axis until said leading edge clears said car, means for shifting said plate along said vertical axis, and means for retracting said plate about a horizontal axis into a stored position on said car.

5. The plow structure according to claim 1, wherein said plate is mountable to a rail car for pivotal movement about a vertical axis, said leading edge sloping rearwardly from said vertical axis, and plow stabilizer means on said plate adjacent said vertical axis for resisting the tendency of said plate from moving about said vertical axis during plow movement, said stabilizer means being adapted for bearing against an abutment formed by trenching along the railway.

6. The plow structure according to claim 5, wherein said plate is supported on a vertical column disposed at said vertical axis, said stabilizer means comprising a vertically disposed stabilizer plate mounted to said column.

7. The plow structure according to claim 1, in combination with a rail car disposed for rolling movement along rails mounted to the ties, said plate being pivotally mounted to said car for movement about a vertical axis, car stabilizer means mounted on said car forwardly of said plate, said means including a pontoon adapted for bearing against an abutment formed by trenching along the railway, said pontoon thereby resisting the tendency of said car to move transversely while ballast is being removed.

8. The combination according to claim 7, wherein said pontoon is connected with means on said car for moving said pontoon from an operable position within the trench to a stored position seated on said car, and further including a cradle on said car for the reception of said pontoon in its stored position.

9. Apparatus for removing ballast from beneath railroad ties, comprising, a vehicle having a flatbed support and being movable in a forward direction along rails mounted on the ties, a horizontally disposed undertrack ballast removal device mounted for movement about a vertical axis to said vehicle, said device comprising an imperforate plate which prevents shifting of the ties by maintaining ballast therebetween during plate movement, a plurality of depending blades mounted on said plate with leading ends thereof spaced along a line sloping rearwardly from one side of said car, said blades curving toward said one side, a scraper plate mounted a distance from the trailing edge of said plate to thereby present at least one opening into which the ballast from between the ties may fall, said scraper plate sloping rearwardly toward said one side, and vehicle stabilizer means mounted on said car forward of said device and extending outwardly of said one side, said stabilizer means including a pontoon extending below the rails for engaging a side of a trench formed for the reception of ballast removed by said blades, said stabilizer means thereby resisting forces imposed on said vehicle which are directed toward said one side during a ballast removal operation.

10. The apparatus according to claim 9, wherein a leading edge of said plate is defined along said rearwardly sloping line, wedges extending forwardly of said leading edge at each of said blade leading ends, the top surface of each said wedge sloping downwardly toward a leading point and sloping along one side thereof rearwardly from said point toward said one side, the leading point of each said wedge being disposed laterally of a trailing end of an adjacent wedge, whereby said wedges may exert a lateral displacement of the ballast without interference from each said adjacent wedge.

11. The apparatus according to claim 9, wherein portions of said plate are articulated for relative movement about a hinge line, means being provided for relatively moving said portions toward one another when said plate is in a non-working position.

12. The apparatus according to claim 9, wherein said blades terminate in straight portions extending toward said one side of said vehicle.

13. The apparatus according to claim 9, wherein said plate is mounted to said vehicle for movement about said vertical axis which is located adjacent said one side, and means on said vehicle being provided for shifting said plate from a working position beneath the ties to a non-working position outwardly of the ties.

14. The apparatus according to claim 13, wherein means on said vehicle are provided for raising said plate toward said flatbed support, further means on said vehicle being provided for moving said raised plate, about a horizontal axis parallel to said one side, from its raised position to a stored position on said vehicle.

15. The apparatus according to claim 14, wherein said shifting means and said moving means include hydraulically operated piston and cylindder units, and said raising means include a vertical column mounted on said plate adjacent said vertical axis, and a hydraulically operated piston and cylinder unit located within said column.

16. The apparatus according to claim 9, wherein said plate is mounted to said vehicle for movement about said vertical axis which is located adjacent said one side, plate stabilizer means depending from said plate adjacent said vertical axis being provided for engaging a wall of a trench formed adjacent the ties for the reception of removed ballast, whereby said plate stabilizer means resist transverse forces imposed on said plate during the ballast removal operation.

17. The apparatus according to claim 16, wherein a vertical upstanding column is provided on said plate, and said plate stabilizer means including a stabilizer plate disposed parallel to said one side and being mounted on said column.

18. The apparatus according to claim 9, wherein said vehicle stabilizer means further include means for moving said pontoon from a working position in the trench to a stored position on said flatbed support.

19. The apparatus according to claim 18, wherein a cradle support is provided on said flatbed support for the reception of said pontoon when moved to its stored position.

20. The apparatus according to claim 11, wherein said hinge line is substantially parallel to said rearwardly sloping line, and said means provided for moving said portions toward one another including a hydraulically operated piston and cylinder unit.

21. A ballast treating method carried out wiith the use of an apparatus moving along a railway track having rails mounted on ties supported by underlying ballast and having ballast in the cribs between the ties, comprising:

forming a trench along one side of the railway adjacent the ties;

removing the ballast from beneath the ties without disturbing the ballast in thhe cribs therebetween so as to avoid separation of the ties during ballast removal, the removal being carried out gradually with a plow structure from one end to the other end of said ties, said plow structure being mounted at a side of the apparatus;

depositing the removed ballast into said trench;

subsequently removing the ballast from the cribs between the ties and depositing same into said trench;

picking up the removed ballast from the trench and conveying it to a cleaning station;

cleaning the picked up ballast at said station; and conveying the cleaned ballast back beneath the ties through the cribs.

22. The method according to claim 21, including the further step of stabilizing the apparatus against forces acting toward said one side during the removal operation.

23. The method according to claim 22, wherein the apparatus is stabilized by means of a pontoon depending from the apparatus in engagement with a wall of the trench.

24. The method according to claim 21, including the further step of stabilizing the plow structure against forces acting toward said one side during the removal operation.

25. The method according to claim 24, wherein the plow structure is stabilized by means of a stabilizer plate depending from said structure in engagement with a wall of the tench.

26. The method according to claim 21, including the further step of regulating the removed ballast in said trench in preparation for the pick-up step.

27. The method according to claim 21, wherein the removal of ballast from beneath the ties is carried out by sequentially piercing and then shifting the ballast toward said one end of said ties so as to avoid interference between portions of the shifted ballast during ballast removal.

* * * * *